US005225306A

United States Patent [19]

Almog et al.

[11] Patent Number: 5,225,306

[45] Date of Patent: Jul. 6, 1993

[54] CHARGE PRIMING AGENTS FOR LIQUID TONERS

[75] Inventors: Yaacov Almog, Rehovot; Frida Avadik, Rishon Le Zion, both of Israel

[73] Assignee: Spectrum Sciences B.V., Wassenaar, Netherlands

[21] Appl. No.: 650,018

[22] Filed: Feb. 4, 1991

[51] Int. Cl.[5] ..... G03G 9/00; G03G 5/00

[52] U.S. Cl. ..... 430/115; 430/137

[58] Field of Search ..... 430/115, 137

[56] References Cited

U.S. PATENT DOCUMENTS 4,144,184 3/1979 Takahata et al. .
4,275,136 6/1981 Murasawa et al. .
4,707,429 11/1987 Trout .
4,780,389 10/1988 El-Sayed .
4,971,883 11/1990 Chan et al. .
4,994,341 2/1991 Adair et al. .
5,034,297 7/1991 Yoerger ..... 430/109

FOREIGN PATENT DOCUMENTS 0373776 6/1990 European Pat. Off. .

*Primary Examiner*—Marion E. McCamish
*Assistant Examiner*—Stephen C. Crossan
*Attorney, Agent, or Firm*—Sandler Greenblum & Bernstein

[57] ABSTRACT

Liquid toner compositions for electrostatic imaging comprise carrier liquid, colorant particles and charge director(s), as well as charge priming agent(s) selected from alkoxides of aluminum and zirconium.

36 Claims, 4 Drawing Sheets

CHARGE PRIMING AGENTS FOR LIQUID TONERS

FIELD OF THE INVENTION

This invention relates to the field of electrostatic imaging and, more particularly, to liquid toners containing charge directors and charge priming agents.

BACKGROUND OF THE INVENTION

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied, thereby forming an electrostatic charge pattern on the photoconductive imaging surface, i.e. a latent electrostatic image. Depending on the nature of the photoconductive surface, the latent image may have either a positive charge (e.g. on a selenium photoconductor) or a negative charge (e.g. on a cadmium sulfide photoconductor). The latent electrostatic image can then be developed by applying to it oppositely charged pigmented toner particles, which adhere to the undischarged "print" portions of the photoconductive surface to form a toner image which is subsequently transferred by various techniques to a copy sheet (e.g. paper).

It will be understood that other methods may be employed to form an electrostatic image, such as, for example, providing a carrier with a dielectric surface and transferring a preformed electrostatic charge to the surface. The charge may be formed from an array of styluses. This invention will be described in respect of office copiers, though it is to be understood that it is applicable to other uses involving electrography.

In liquid-developed electrostatic imaging, the toner particles are generally dispersed in an insulating nonpolar liquid carrier, generally an aliphatic hydrocarbon fraction, which generally has a high volume resistivity above $10^9$ ohm cm, a dielectric constant below 3.0 and a low vapor pressure (less then 10 torr. at 25° C.). The liquid developer system further comprises so-called charge directors, i.e. compounds capable of imparting to the toner particles an electrical charge of the desired polarity and uniform magnitude so that the particles may be electrophoretically deposited on the photoconductive surface to form a toner image.

In the course of the process, a thin film of the liquid developer is applied to and covers the entire photoconductive imaging surface. The charged toner particles in the liquid developer film migrate to the oppositely-charged areas forming the "print" portions of the latent electrostatic image, thereby forming the toner image and any liquid developer remaining on the photoconductive surface after this stage of the process is recycled back into the liquid developer reservoir.

Charge director molecules play an important role in the above-described developing process in view of their function of controlling the polarity and magnitude of the charge on the toner particles. The choice of a particular charge director for use in a specific liquid developer system, will depend on a comparatively large number of physical characteristics of the charge director compound, inter alia its solubility in the carrier liquid, its chargeability, its high electric field tolerance, its release properties, its time stability, etc. All these characteristics are crucial to achieve high quality imaging, particularly when a large number of impressions are to be produced.

A wide range of charge director compounds for use in liquid-developed electrostatic imaging are known from the prior art. Examples of charge director compounds are ionic compounds, particularly metal salts of fatty acids, metal salts of sulfo-succinates, metal salts of oxyphosphates, metal salts of alkyl-benzenesulfonic acid, metal salts of aromatic carboxylic acids or sulphonic acids, as well as zwitterionic and non-ionic compounds, such as polyoxyetheylated alkylamines, lecithin, polyvinylpyrrolidone, organic acid esters of polyvalent alcohols, etc.

In an attempt to improve the quality of the image formed, particularly when using liquid toners containing charge directors, it has been suggested to use adjuvants in the toner compositions, such as polyhydroxy compounds, aminoalcohols, polybutylene succinimide, an aromatic hydrocarbon, a metallic soap or a salt of a Group Ia, IIa, or IIIa metal.

Thus, for example, in U.S. Pat. No. 4,707,429 entitled "Metallic Soap as Adjuvant for Electrostatic Liquid Developer", a metallic soap adjuvant was used in a toner composition which contained a nonpolar liquid soluble ionic or zwitterionic charge director compound, while in U.S. Pat. No. 4,780,389 entitled "Inorganic Metal Salt as Adjuvant for Negative Liquid Electrostatic Developers", a salt of a Group Ia, IIa, or IIIa metal with specified anions was used as adjuvant in a toner composition which contained a nonpolar liquid soluble ionic or zwitterionic charge director compound which imparts a negative charge to thermoplastic resin particles in the toner. The disclosures in both of these U.S. patents is explicitly incorporated herein by reference.

As stated in each of these U.S. patents, even when the prior adjuvants are used in conjunction with charge directors, the images obtained using some toner formulations suffer from one or more of the following disadvantages, namely, low resolution, poor solid area coverage (density), image squash and ghosting.

SUMMARY OF THE INVENTION

It is an object of the present invention to provide improved liquid toner compositions containing charge directors and charge priming agents. Other objects of the invention will appear from the description which follows.

The present invention accordingly provides liquid toner compositions for electrostatic imaging, which comprise colorant particles, at least one charge director and at least one charge priming agent selected from alkoxides of aluminum and zirconium.

We have found that the colorant particles in such compositions exhibit excellent time stability of charge, high mobility and give rise to images of very good copy quality.

In a particular embodiment, the present invention provides liquid toner compositions for electrostatic imaging, which comprise:

thermoplastic colorant resin particles dispersed in an insulating non polar carrier liquid having a volume resistivity above $10^9$ ohm-cm and a dielectric constant below 3.0;

at least one charge director; and at least one charge priming agent selected from alkoxides of aluminum and alkoxides of zirconium. Alkoxides of other tri-valent metals are believed to be useful in the practice of the invention as well.

The present invention moreover provides an electrostatic imaging process which comprises the steps of:

forming a charged latent electrostatic image on a photoconductive surface;

applying to said surface charged toner particles from a toner composition according to the present invention, thereby to form a toner image on said surface; and transferring the resulting toner image to a substrate.

For purposes of definition in the present specification and claims, it is to be noted that the term alkoxides is intended to include the unsubstituted alkoxide moiety, saturated cyclic alkoxide (e.g. cycloalkyloxy and cycloalkylakoxy), and the alkoxide moiety which is otherwise substituted by one to three radicals which do not have an adverse effect on the charge priming characteristics of the metal alkoxides.

DETAILED DESCRIPTION OF THE INVENTION

Figure 1:
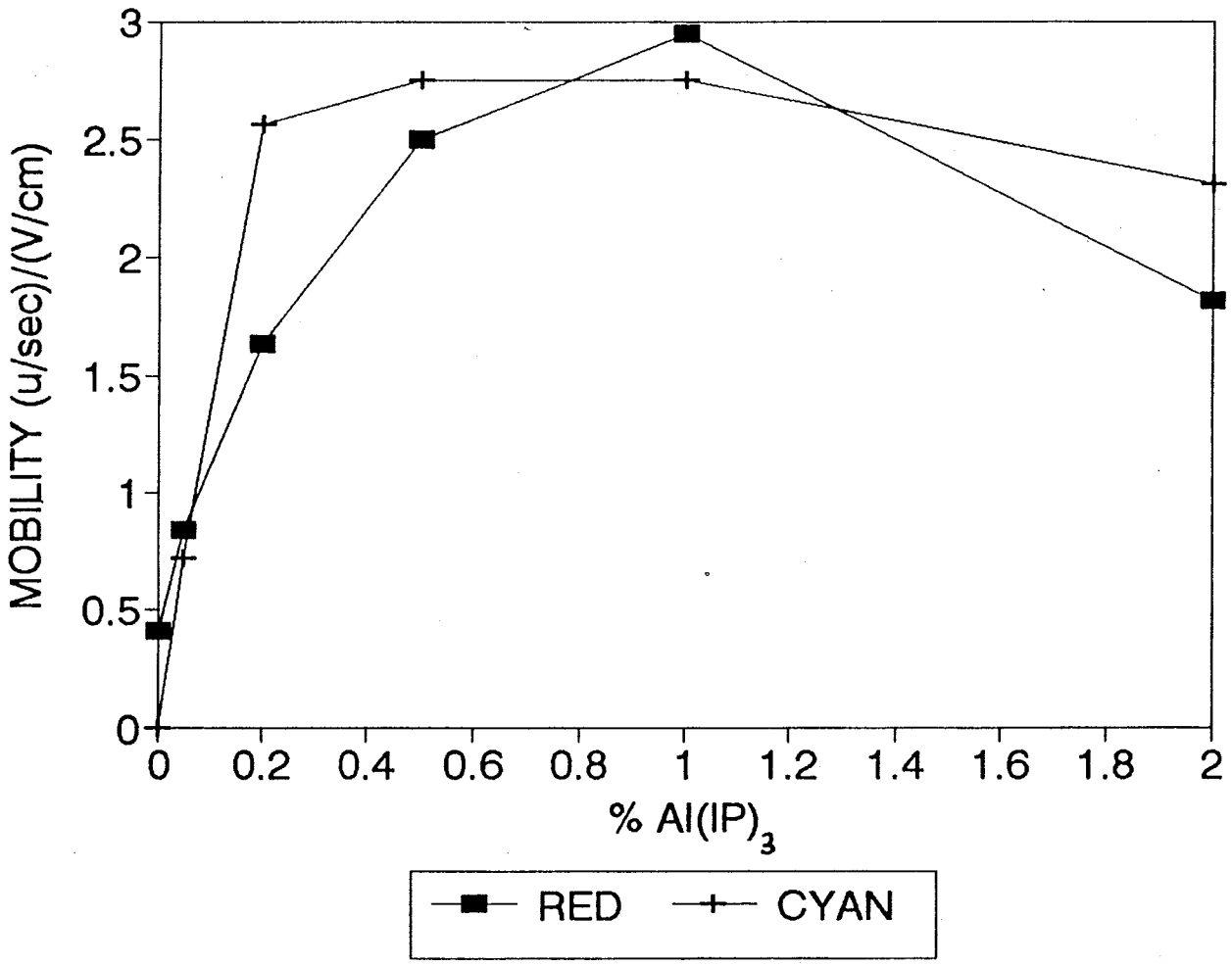
FIGS. 1-4 show the effect of varying amounts of a charge priming agent in accordance with the invention, on the mobility of toner particles in different liquid toner compositions.

The thermoplastic resins, insulating non polar carrier liquids, colorant particles and charge directors, which may suitably be used in the toner compositions of the invention are known in the art, for example in the two U.S. patents mentioned above. Illustratively, the insulating non-polar liquid carrier, which should preferably also serve as the solvent for the charge directors, is most suitably an aliphatic hydrocarbon fraction having suitable electrical and other physical properties. Preferred solvents are the series of branched-chain aliphatic hydrocarbons and mixtures thereof, e.g. the isoparaffinic hydrocarbon fractions having a boiling range above about 155° C., which are commercially available under the name Isopar (a trademark of the Exxon Corporation). Other carrier liquids such as NORPARs, mineral oils etc., are also useful in the practice of the invention.

The charge priming agents utilized in accordance with the present invention are selected from alkoxides of aluminum and zirconium. Aluminum alkoxides are presently preferred. The alkoxide moieties in the charge priming agents may for example be selected from unsubstituted alkoxide moieties having preferably 1-12 carbon atoms, including, for example, methoxy, ethoxy, propoxy, isopropoxy, butoxy, isobutoxy, pentoxy, hexoxy, heptoxy, octoxy, nonoxy, decoxy, undecoxy and dodecoxy, those having 1-6 carbon atoms being particularly preferred. However, as pointed out above, "alkoxide" in the present specification and claims includes saturated cyclic alkoxide (e.g. cycloalkyloxy and cycloalkylalkoxy such as cyclopropoxy, cyclobutoxy, cyclopentoxy, cyclohexoxy, cycloheptoxy and cyclooctoxy, as well as cyclohexylmethoxy and 2-cyclohexylethoxy), as well as the alkoxide moiety which is substituted by one to three radicals which do not have an adverse effect on the charge priming characteristics of the metal alkoxides. Such substituents may be for example, halogen such as chlorine or fluorine, alkoxy such as methoxy or ethoxy, and aryl such as phenyl. Thus, such substituted alkoxide radicals include illustratively, 2-chloroethyl, 2,2,2-trifluoroethyl, 2-methoxyethyl, benzyl and 2-phenylethyl.

It will be appreciated that the alkoxides useful as charge priming agents in accordance with the present invention contain a multiplicity of alkoxide radicals, and that these radicals in any one aluminum or zirconium alkoxide may be the same as each other, or different from each other.

The charge priming agents may be included in the liquid toners by any suitable method, and the methods exemplified herein are to be regarded as illustrative only, and not limitative. In a particular embodiment, the charge priming agent is admixed with the diluted toner and the mixture allowed to equilibrate. In another embodiment, the charge priming agent is ground with toner concentrate. It is presently preferred to add the charge director to the diluted toner which is otherwise ready for use, i.e. after the charge priming agent has been incorporated.

The invention will be illustrated by the following non-limiting Examples, in which all "parts" are parts by weight. All ratios or percentages are with respect to the non-volatile portion of the liquid toner and refer to the non-volatile solids portions of the respective materials.

The charge director used in all the Examples is prepared as follows.

PREPARATION OF CHARGE DIRECTOR

A four-necked 2 liter glass reactor fitted with a mechanical stirrer and reflux condenser was charged with 300 g. of a solution of 10% lecithin (Fisher) in Isopar H and 280 g. of 10% basic barium petronate (Witco) solution in Isopar H. To the resulting solution, heated to 80° C., 6 g of 1-vinyl-2-pyrrolidone was added, followed by 20 g. of a solution of 6 g. lauroyl peroxide (Aldrich) in Isopar H. The mixture was heated to 95° C., and the reaction was allowed to proceed while stirring for 10 hours in a nitrogen atmosphere.

EXAMPLE I—Cyan (a) Ten parts of Elvax II 5720 (E. I. du Pont) and five parts of Isopar L (Exxon) are mixed at low speed in a double jacketed planetary mixer connected to an oil heating unit set at 130° C. for one hour. A mixture of 1.75 parts of Helioecht Blue (Bayer) and 5 parts of Isopar L are added to the mix in the double planetary mixer and the whole is mixed for a further hour at high speed. Ten parts of Isopar L, preheated to 110° C., are added, and mixing is continued without heating until the temperature of the mixture drops to 40° C.

(b) The product of part (a) is diluted with Isopar L to a non-volatile solids content of 11.5%, and transferred to a Sweco grinder, using 0.5 inch cylindrical alumina media and is ground for 41 hours with water cooling. The final median diameter of the resultant toner particles is 2.3 μm.

(c) The toner concentrate from part (b) is diluted to a non-volatile solids content of 1.5%, using Isopar H. 100 g portions of the product are then charged with various amounts of aluminum tri(isopropoxide) ("$Al(IP)_3$"), obtained from Aldrich) as indicated in FIG. 1. The toner is left to equilibrate for 24 hours, then 50 mg./g. charge director is added. Mobility values for different proportions of $Al(IP)_3$ are shown in FIG. 1. For measurement of mobility, see e.g. "Measurements of the Electrophoretic Mobility of Toner Suspensions", by Niv, Y., et al, 3rd Intl. Congress on Advances in Non- Impact Printing Technologies/SPSE, 24–28 August, 1986, the disclosure of which is incorporated herein by reference.

EXAMPLE II—Red (a) Thirty grams of a mixture of 86.5% of Elvax II 5720 and 13.5% of pigment red 6300 (E. I. du Pont) are melted together with 70 grams of Isopar L at 130° C. until the blend is homogeneous.

(b) The product of part (a) is allowed to cool to room temperature and transferred to an 01 attritor (Union Process), together with an additional 100 g. of Isopar L. The mixture is ground using stainless steel balls and water cooling (≈20° C.) for 22 hours, yielding a concentrate of median particle size 2.0 μm.

(c) The toner concentrate from part (b) is diluted to a non-volatile solids content of 1.5%, using Isopar H. 100 g portions of the product are then charged with various amounts of $Al(IP)_3$ as indicated in FIG. 1. The toner is left to equilibrate for 24 hours, then 50 mg./g. charge director is added. Mobility values for the different proportions of $Al(IP)_3$ are shown in FIG. 1.

EXAMPLE III—Cyan (a) Ten parts of Elvax II 5950 (E. I. du Pont) and five parts of Isopar L (Exxon) are mixed at low speed in a jacketed double planetary mixer connected to an oil heating unit set at 130° C. for one hour. 5 parts of Isopar L are added to the mix and the whole is mixed for a further hour at high speed. Ten parts of Isopar L, preheated to 110° C., are added, and mixing is continued without heating until the temperature of the mixture drops to 40° C.

(b) Ninety grams of the product of part (a) is transferred to an 01 attritor together with 4.35 g. of Pigment cyan BT-583 (Heaubch) and 120 g. Isopar L. The mixture is ground for 22 hours with water cooling (≈20° C). The resultant toner particles have a median (weight) diameter of about 1.9 μm.

Figure 3:
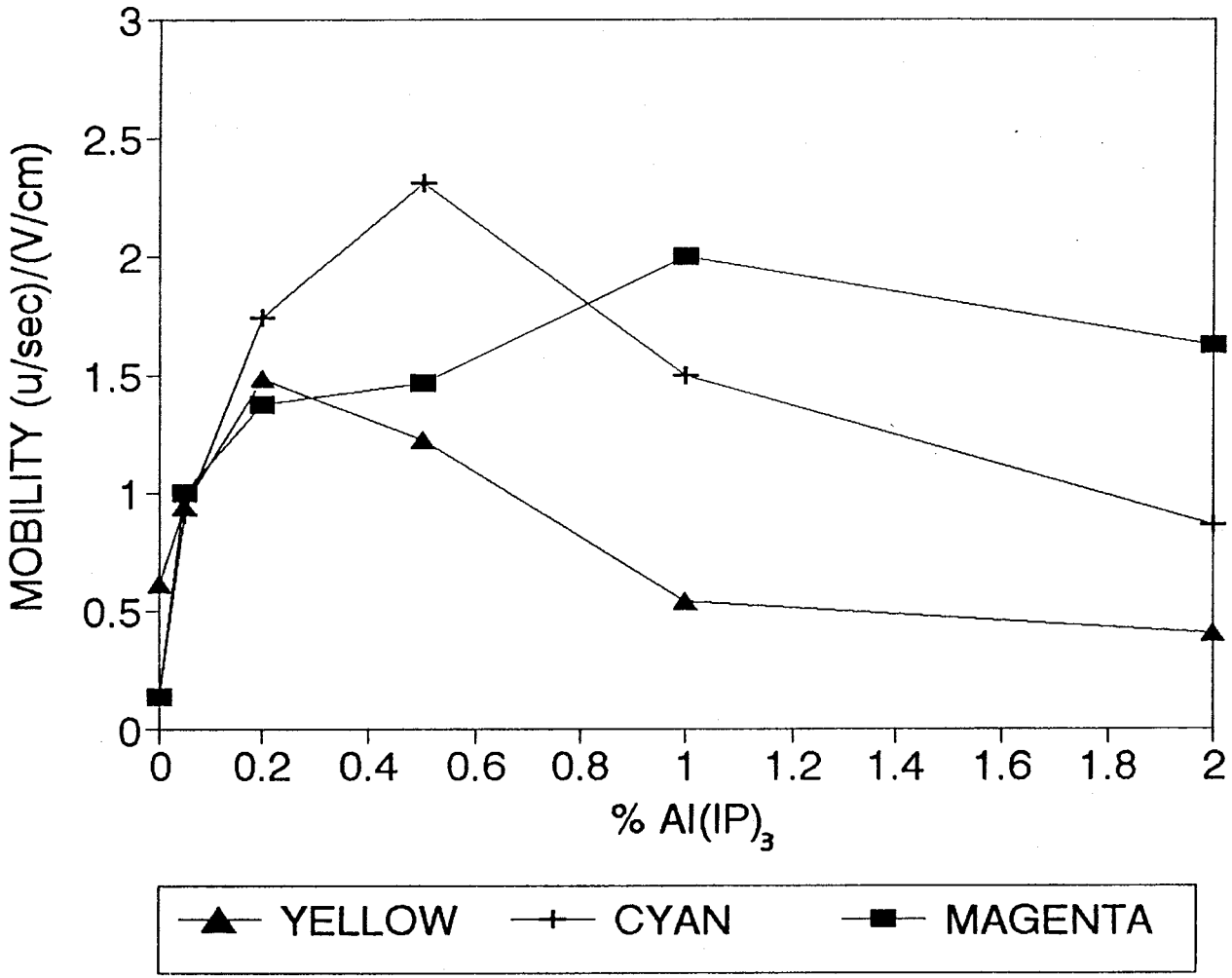

(c) The toner concentrate from part (b) is diluted to a non-volatile solids content of 1.5%, using Isopar H. 100 g portions of the product are then charged with increased amounts of $Al(IP)_3$, as indicated in FIG. 3. The toner is left to equilibrate for 24 hours, then 50 mg./g. charge director is added.

EXAMPLE IV—Black (a) Ten parts of Elvax II 5950 (E. I. du Pont) and five parts of Isopar L (Exxon) are mixed at low speed in a jacketed double planetary mixer connected to an oil heating unit set at 130° C. for one hour. 5 parts of Isopar L are added to the mix and the whole is mixed for a further hour at high speed. Ten parts of Isopar L, preheated to 110° C., are added, and mixing is continued without heating until the temperature of the mixture drops to 40° C.

(b) Ninety grams of the product of part (a) is transferred to a 01 attritor together with 7.5 g. of Mogul L (Cabot) and 120 g. Isopar L. The mixture is ground for 24 hours with water cooling (≈20° C). The resultant toner particles have a median (by weight) diameter of about 2.1 μm.

(c) The toner concentrate from part (b) is diluted to a non-volatile solids content of 1.5%, using Isopar H. 100 g portions of the product are then charged with various amounts of $Al(IP)_3$, as indicated in FIG. 3. The toner is left to equilibrate for 24 hours, then 50 mg./g. charge director is added.

EXAMPLE V—Magenta (a) Ten parts of Elvax II 5950 (E. I. du Pont) and five parts of Isopar L (Exxon) are mixed at low speed in a jacketed double planetary mixer connected to an oil heating unit set at 130° C. for one hour. 5 parts of Isopar L are added to the mix and the whole is mixed for a further hour at high speed. Ten parts of Isopar L, preheated to 110° C., are added, and mixing is continued without heating until the temperature of the mixture drops to 40° C.

(b) Ninety grams of the product of part (a) is transferred to an 01 attritor together with 4.5 g. of Pigment F2B Fine Red (Toyo Ink) and 120 g. Isopar L. The mixture is ground for 22 hours with water cooling (≈20° C). The resultant toner particles have a median (by weight) diameter of about 0.8 μm.

(c) The toner concentrate from part (b) is diluted to a non-volatile solids content of 1.5%, using Isopar H. 100 g portions of the product are then charged with various amounts of $Al(IP)_3$, as indicated in FIG. 3. The toner is left to equilibrate for 24 hours, then 50 mg./g. charge director is added.

EXAMPLE VI—Cyan (a) Ten parts of Elvax II 5720 (E. I. du Pont) and five parts of Isopar L (Exxon) are mixed at low speed in a jacketed planetary mixer connected to an oil heating unit set at 130° C. for one hour. A mixture of 1.75 parts Helioecht Blue and 5 parts of Isopar L are added to the mix and the whole is mixed for an additional hour at high speed. Ten parts of Isopar L, preheated to 110° C., are added, and mixing is continued without heating until the temperature of the mixture drops to 40° C.

(b) The product of part (a) is diluted with Isopar L to a non-volatile solids content of 11.5% and transferred to a Sweco grinder using 0.5 inch cylindrical alumina media and is ground for 41 hours with water cooling. The final median diameter of the resultant toner particles is 2.3 μm.

(c) Two hundred grams of the toner concentrate from part (b) is transferred into a Union Process 01 attritor and 0.52 g. of $Al(IP)_3$ is added. The mixture is ground for two hours. It is then diluted to 1.5% non-volatile solids content, after a 24 hour waiting period. 50 mg./g. charge director is added to 100 g. of the above working dispersion. The mobility value is 2.5 on a scale on which the mobility for similar material without added $Al(IP)_3$ is zero.

EXAMPLE VII—Cyan

When Example VI was repeated, but substituting aluminum tri(isobutoxide) for the $Al(IP)_3$, similar results are obtained.

EXAMPLE VIII—Cyan

When Example VI was repeated, but substituting aluminum tri(ethoxide) for the $Al(IP)_3$, similar results are obtained.

EXAMPLE IX—Yellow (a) Thirty grams of a mixture of 86.5% of Elvax II 5650T and 13.5% of Sicomett Yellow D-1350 (BASF) are melted together with 70 grams of Isopar L at 100° C. until a homogeneous blend is obtained.

(b) The product of part (a) is allowed to cool to room temperature and transferred to an 01 attritor together with an additional 100 g. of Isopar L. The mixture is ground using stainless steel balls and water cooling (≈20° C.) for 22 hours, yielding a concentrate of median particle size of 1.7 μm.

Figure 2:
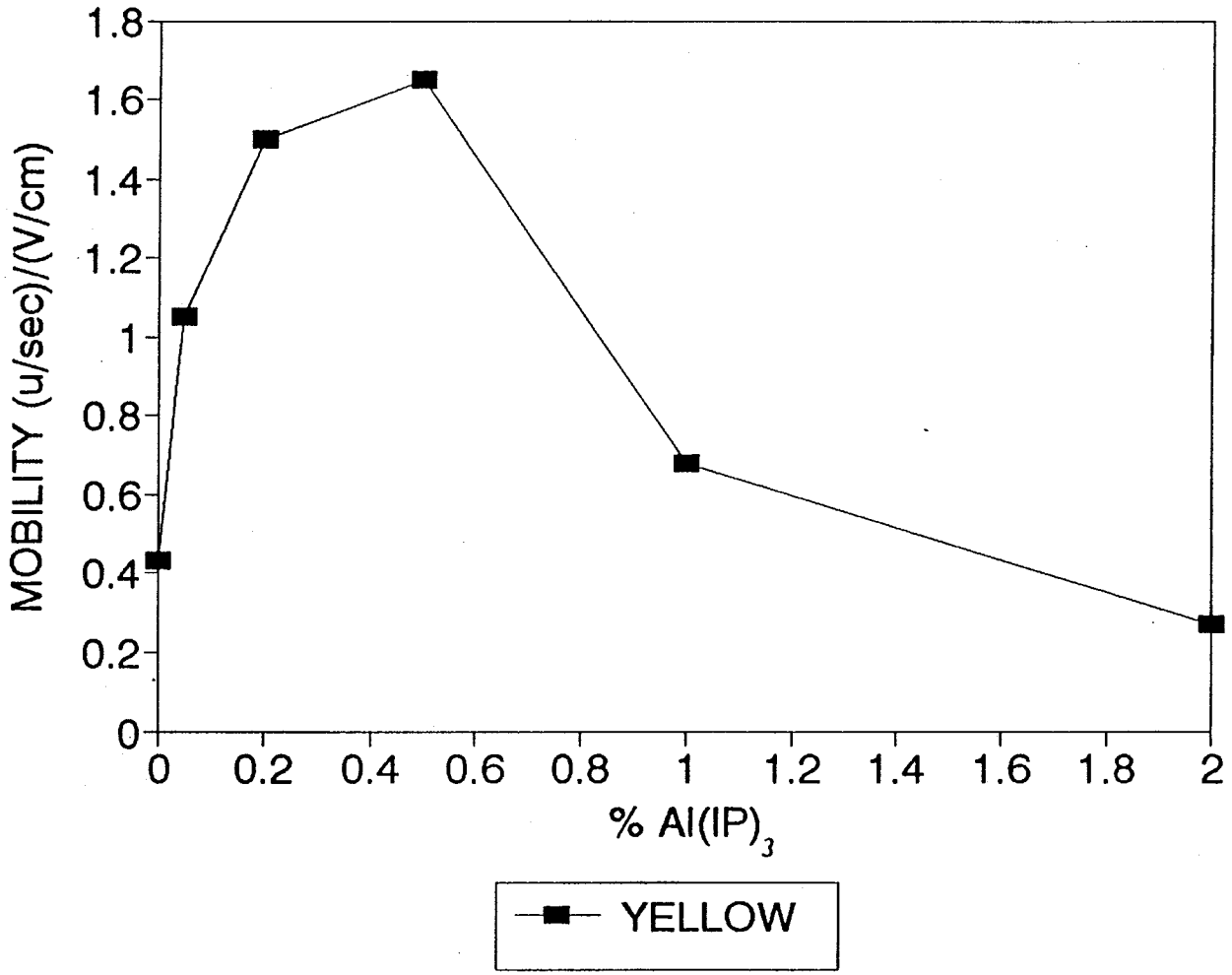

(c) The toner concentrate from part (b) is diluted to a non-volatile solids content of 1.5%, using Isopar H. 100 g portions of the product are then charged with various amounts of $Al(IP)_3$ as indicated in FIG. 2. The toner is left to equilibrate for 24 hours, then 50 mg./g. charge director is added. Mobility values for the different proportions of $Al(IP)_3$ are shown in FIG. 2.

EXAMPLE X—Cyan (a) Ten parts of Elvax II 5720 (E. I. du Pont) and five parts of Isopar L (Exxon) are mixed at low speed in a jacketed planetary mixer connected to an oil heating unit set at 130° C. for one hour. A mixture of 1.75 parts Helioecht Blue and 5 parts of Isopar L are added to the mix and the whole is mixed for an additional hour at high speed. Ten parts of Isopar L, preheated to 110° C., are added, and mixing is continued without heating until the temperature of the mixture drops to 40° C.

(b) The product of part (a) is diluted with Isopar L to a non-volatile solids content of 11.5% and transferred to a Sweco grinder using 0.5 inch cylindrical alumina media and is ground for 22 hours with water cooling (≈20° C). The resultant toner particles have a median diameter of 2.3 μm.

(c) 220 g. of the toner concentrate from part (b) is transferred into an 01 attritor and 0.52 g. of $Al(IP)_3$ is added. The mixture is ground for two hours. It is then diluted with Isopar H to 1.5% non-volatile solids content, after a 24 hour waiting period. 1.2 kg. of the 1.5% dispersion is charged with 7 mg./g. charge director and placed in an 870 Savin photocopier. This copier had been modified to allow for varying process voltages. The potential on the photoconductor is regulated to 1400 V and the potential applied on the transfer corotron is 9 KV. The copy quality parameters as measured using the Macbeth type TR 927 reflection densitometer, are summarized in Table 1.

TABLE 1

| | Control (no $Al(IP)_3$) | | $Al(IP)_3$ Treated | |
|---|---|---|---|---|
| | S.A.D. | T.E. | S.A.D. | T.E. |
| Savin 2200+ | 0.36 | 25% | 1.46 | 88% |
| Printers Stock | 0.85 | 42% | 1.70 | 84% |

Where T.E. is the transfer efficiency of image transfer from the photoconductor to the substrate and S.A.D. is the solid area density of the transferred image.

EXAMPLE XI—Black (a) Ten parts of Surlyn 1652 (E. I. du Pont) and five parts of Isopar L (Exxon) are mixed at low speed in a jacketed double planetary mixer connected to an oil heating unit set at 130° C. for one hour. 5 parts of Isopar L are added to the mix and the whole is mixed for an additional hour at high speed. Ten parts of Isopar L, preheated to 110° C., are added, and mixing is continued at high speed for another hour.

(b) One hundred grams of the product of part (a) is transferred to an 01 attritor together with 3.9 g. Elftex 12 carbon black (Cabot) and 120 g. Isopar L. The mixture is ground for 24hours using water cooling (≈20° C). The resultant toner particles have a median (by weight) diameter of 1.6 μm.

Figure 4:
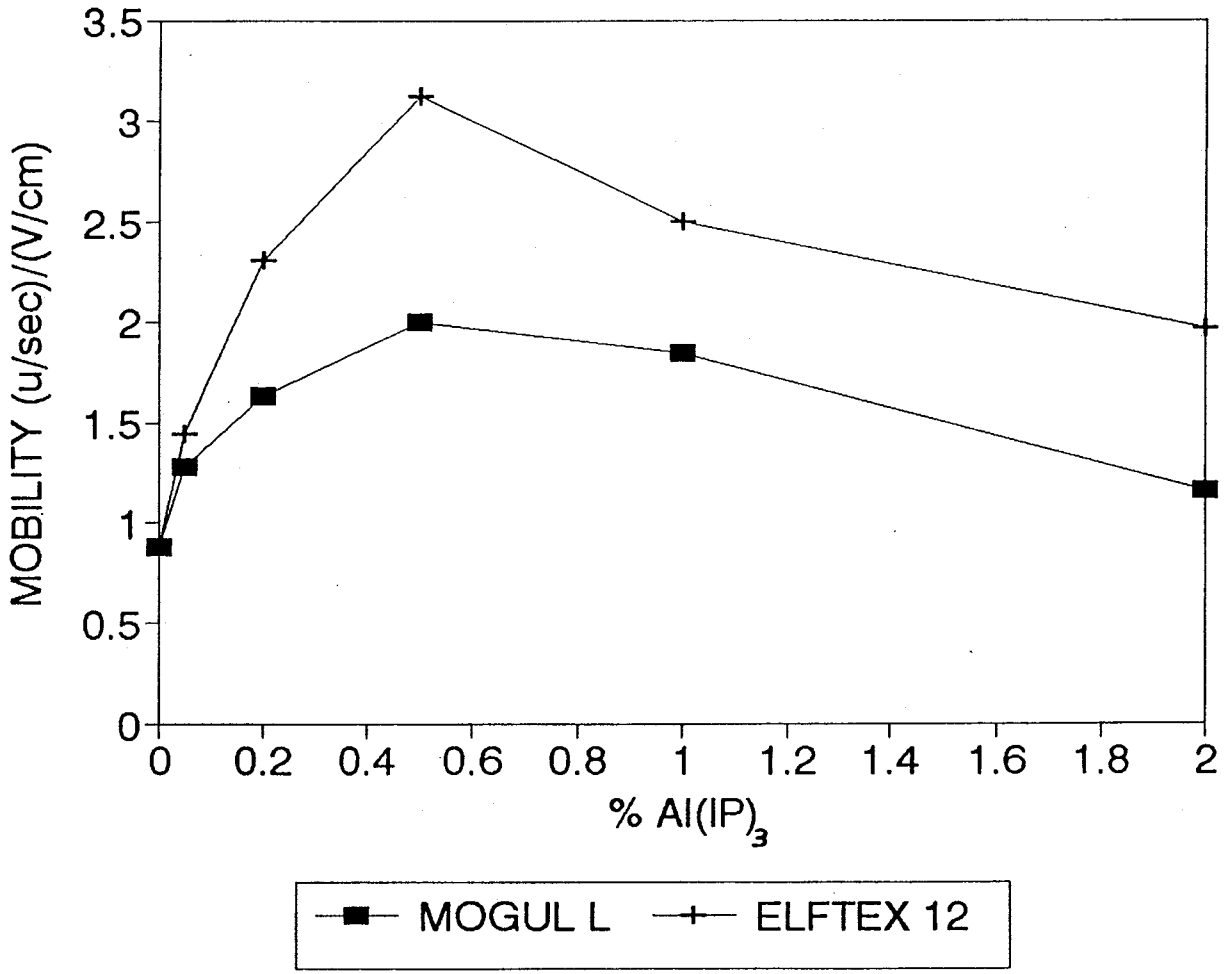

(c) The toner concentrate from part (b) is diluted to a non-volatile solids content of 1.5%, using Isopar H. 100 g portions of the product are then charged with various amounts of $Al(IP)_3$, as shown in FIG. 4. The toner is left to equilibrate for 24 hours, then 50 mg./g. charge director is added. Mobility values for the different proportions of $Al(IP)_3$ are shown in FIG. 4.

EXAMPLE XII—Black (a) Ten parts of Surlyn 1652 (E. I. du Pont) and five parts of Isopar L (Exxon) are mixed at low speed in a jacketed double planetary mixer connected to an oil heating unit set at 130° C. for one hour. 5 parts of Isopar L are added to the mix and the whole is mixed for an additional hour at high speed. Ten parts of Isopar L, preheated to 110° C., are added, and mixing is continued at high speed for another hour.

(b) One hundred grams of the product of part (a) is transferred to an 01 attritor together with 3.9 g. Mogul L and 120 g. Isopar L. The mixture is ground for 24 hours using water cooling (≈20° C). The resultant toner particles have a median (by weight) diameter of 1.6 μm.

(c) The toner concentrate from part (b) is diluted to a non-volatile solids content of 1.5%, using Isopar H. 100 g portions of the product are then charged with various amounts of $Al(IP)_3$, as shown in FIG. 4. The toner is left to equilibrate for 24 hours, then 50 mg./g. charge director is added. Mobility values for the different proportions of $Al(IP)_3$ are shown in FIG. 4.

EXAMPLE XIII—Yellow (a) Ten parts of Surlyn 1652 (E. I. du Pont) and five parts of Isopar L (Exxon) are mixed at low speed in a jacketed planetary mixer connected to an oil heating unit set at 130° C. for one hour. 5 parts of Isopar L are added to the mix and the whole is mixed for an additional hour at high speed. Ten parts of Isopar L, preheated to 110° C., are added, and mixing is continued at high speed for another hour. Mixing is continued after removing the heat source, until the temperature of the mixture drops to 40° C.

(b) Ninety grams of the product of part (a) is transferred to an 01 attritor together with 3.1 g. Sicomett Yellow D-1350 and 120 g. Isopar L. The mixture is ground for 26 hours using water cooling (≈20° C). The resultant toner particles have a median (weight) diameter of 0.6 μm.

(c) The toner concentrate from part (b) is diluted to a non-volatile solids content of 1.5%, using Isopar H. 100 g portions of the product are then charged with various amounts of $Al(IP)_3$, as shown in FIG. 3. The toner is left to equilibrate for 24 hours, then 50 mg./g. charge director is added. Mobility values for the different proportions of $Al(IP)_3$ are shown in FIG. 3.

EXAMPLE XIV—Cyan (a) Ten parts of Surlyn 1652 (E. I. du Pont) and five parts of Isopar L (Exxon) are mixed at low speed in a jacketed planetary mixer connected to an oil heating unit set at 130° C. for one hour. 5 parts of Isopar L are added to the mix and the whole is mixed for an additional hour at high speed. Ten parts of Isopar L, preheated to 110° C., are added, and mixing is continued at high speed for another hour. Mixing is continued after removing the heat source, until the temperature of the mixture drops to 40° C.

(b) One hundred grams of the product of part (a) is transferred to an 01 attritor together with 3.45 g. of Cyan BT 583 pigment and 100 g. Isopar L. The mixture is ground for 24 hours using water cooling (=20° C). The resultant toner particles have a median (weight) diameter of 0.8 μm.

(c) The toner concentrate from part (b) is diluted to a non-volatile solids content of 1.5%, using Isopar H. 100 g portions of the product are then charged with various amounts of $Al(IP)_3$, as shown in FIG. 3. The toner is left to equilibrate for 24 hours, then 50 mg./g. charge director is added. Mobility values for the different proportions of $Al(IP)_3$ are shown in FIG. 3.

EXAMPLE XV—Magenta (a) 10 parts of Surlyn 1652 (E. I. du Pont) and 5 parts of Isopar L (Exxon) are mixed at low speed in a jacketed planetary mixer connected to an oil heating unit set at 130° C. for one hour. 5 parts of Isopar L are added to the mix and the whole is mixed for an additional hour at high speed. Ten parts of Isopar L, preheated to 110° C., are added, and mixing is continued at high speed for another hour. Mixing is continued after removing the heat source, until the temperature of the mixture drops to 40° C.

(b) One hundred grams of the product of part (a) is transferred to an 01 attritor together with 3.45 g. of Pigment F2B Fine Red (Toyo Ink) and 100 g. Isopar L. The mixture is ground for 24 hours using water cooling (≈20° C). The resultant toner particles have a median (by weight) diameter of 0.7 μm.

(c) The toner concentrate from part (b) is diluted to a non-volatile solids content of 1.5%, using Isopar H. 100 g portions of the product are then charged with various amounts of $Al(IP)_3$, as shown in FIG. 3. The toner is left to equilibrate for 24 hours, then 50 mg./g. charge director is added. Mobility values for the different proportions of $Al(IP)_3$ are shown in FIG. 3.

EXAMPLE XVI (a) Ten parts of Elvax II 5720 (E. I. du Pont) and five parts of Isopar L (Exxon) are mixed at low speed in a jacketed double planetary mixer connected to an oil heating unit set at 130° C. for one hour. Five parts of Isopar L are added to the mix and the whole is mixed for an additional hour at high speed. Five parts of Isopar L, preheated to 110° C., are added and mixing is continued at high speed for a further hour. The heating unit is then disconnected and mixing is continued until the temperature of the mixture drops to 40° C.

(b) A mixture of 750 g. of the product of part (a), 53 g. Lionel Red 4576 (Toyo Ink) and 1100 g. of Isopar L, is ground for 24 hours in a Union Process 1S attritor, using stainless steel balls, with water cooling. The final median diameter is 0.7μ.

(c) The concentrate prepared in (b) was diluted to a 9.4% non-volatile solids content and 220 g. were transferred to an 01 attritor and ground for 2 hours, using water cooling.

(d) The concentrate prepared in (b) was diluted to a 9.4% non-volatile solids content and 220 g. were transferred to an 01 attritor, together with 0.206 g. $Al(IP)_3$, and the mixture ground for 2 hours, using water cooling.

(e) The concentrate prepared in (c) was suspended in Isopar L at a dilution of 1.5% non-volatile solid content, and charge director was added in the proportion of 28 mg./g. of toner solids. This developer was tested in an 870 Savin photocopier. This copier had been modified to allow for varying process voltages. The potential on the photoconductor is regulated to 1400 V and the potential applied on the transfer corotron is 9 KV. The copy quality parameters as measured using the Macbeth type TR 927 reflection densitometer, are summarized in Table 2 ("Control"). This material charges in a bi-polar manner, i.e. some of the particles charge positive and some negative.

(f) The concentrate prepared under (d) was treated exactly as described in (e) and gave the results noted in Table 2 ("$Al(IP)_3$ treated").

TABLE 1

| | Control (no $Al(IP)_3$) | | $Al(IP)_3$ Treated | |
|---|---|---|---|---|
| | S.A.D. | T.E. | S.A.D. | T.E. |
| Savin 2200+ | 0.80 | 74% | 1.43 | 96% |
| Printers Stock | 1.10 | 86% | 1.90 | 97% |

Where T.E. is the transfer efficiency of image transfer from the photoconductor to the substrate and S.A.D. is the solid area density of the transferred image.

While the present invention has been particularly described, persons skilled in the art will appreciate that many variations and modification can be made. Therefore, the invention is not to be construed as restricted to the particularly described embodiments, rather the scope, spirit and concept of the invention will be more readily understood by reference to the claims which follow.

We claim:

1. Liquid toner compositions for electrostatic imaging, which comprise colorant particles surface reacted with at least one charge priming agent selected from alkoxides of aluminum and alkoxides of zirconium, a carrier liquid and at least one charge director.

2. Liquid toner compositions according to claim 1, wherein said colorant particles comprise thermoplastic resin.

3. Liquid toner compositions according to claim 1, wherein the alkoxide moieties in said metal alkoxides are selected from unsubstituted alkoxide moieties, saturated cyclic alkoxide moieties, and alkoxide moieties which are otherwise substituted by one to three radicals which do not have an adverse effect on the charge priming characteristics of the metal alkoxides, provided that the alkoxide moieties in any metal alkoxide charge priming agent may be the same or different.

4. Liquid toner compositions according to claim 3, wherein said unsubstituted alkoxide moieties contain 1–12 carbon atoms.

5. Liquid toner compositions according to claim 4, wherein said unsubstituted alkoxide moieties contain 1–6 carbon atoms.

6. Liquid toner compositions according to claim 3, wherein said saturated cyclic alkoxide moieties are selected from cycloalkyloxy and cycloalkylalkoxy.

7. Liquid toner compositions according to claim 3, wherein the substituents in said otherwise substituted alkoxy moieties are selected from halogen, alkoxy and aryl.

8. Liquid toner compositions according to claim 1, wherein said particles are surface treated with said at least one charge priming agent by adding it to such composition and allowing the mixture to come to equilibrium with the carrier liquid and colorant particles before the incorporation of said at least one charge director in said composition.

9. An electrostatic imaging process which comprises the steps of:

forming a latent electrostatic image on a surface;

applying to said surface charged colorant particles from a liquid toner composition according to claim 1, thereby forming a developed toner image on said surface; and transferring the resulting toner image to a substrate.

10. Process according to claim 9, wherein said colorant particles comprise a thermoplastic resin.

11. Process according to claim 9, wherein the alkoxide moieties in said metal alkoxides are selected from unsubstituted alkoxide moieties, saturated cyclic alkoxide moieties, and alkoxide moieties which are otherwise substituted by one to three radicals which do not have an adverse effect on the charge priming characteristics of the metal alkoxides, and in the case where said metal alkoxides contain more than one alkoxide moiety in the molecule, the alkoxide moieties may be the same or different.

12. Process according to claim 9, wherein said unsubstituted alkoxide moieties contain 1-12 carbon atoms.

13. Process according to claim 12, wherein said unsubstituted alkoxide moieties contain 1-6 carbon atoms.

14. Process according to claim 9, wherein said saturated cyclic alkoxide moieties are selected from cycloalkyloxy and cycloalkylalkoxy.

15. Process according to claim 9, wherein the substituents in said otherwise substituted alkoxy moieties are selected from halogen, alkoxy and aryl.

16. Process according to claim 9, wherein said particles are surface reacted with said at least one charge priming agent by adding it to such composition and allowing the mixture to come to equilibrium with the carrier liquid and colorant particles before the incorporation of said at least one charge director in said composition.

17. Liquid toner compositions according to claims 1 wherein said alkoxides comprise alkoxides of aluminum.

18. Liquid toner compositions according to claim 17 wherein said alkoxide comprises aluminum tri(isopropoxide).

19. Liquid toner compositions according to claims 17 wherein said alkoxide comprises aluminum tri(isobutoxide).

20. Liquid toner compositions according to claim 17 wherein said alkoxide comprises aluminum tri(ethoxide).

21. Process according to claims 9 wherein said alkoxides comprise alkoxides of aluminum.

22. Process according to claim 21 wherein said alkoxide comprises aluminum tri(isopropoxide).

23. Process according to claims 21 wherein said alkoxide comprises aluminum tri(isobutoxide).

24. Process according to claim 21 wherein said alkoxide comprises aluminum tri(ethoxide).

25. A process for producing a liquid toner composition for electrostatic imaging, which composition comprises colorant particles, a carrier liquid, and at least one charge director, said process comprising the steps of:

dispersing the colorant particles in the carrier liquid;

treating the dispersed colorant particles by adding thereto at least one charge priming agent selected from alkoxides of aluminum and alkoxides of zirconium to form a mixture; and adding the at least one charge director to said mixture.

26. A process according to claim 25, wherein said colorant particles comprise thermoplastic resin.

27. A process according to claim 25, wherein the alkoxide moieties in said metal alkoxides are selected from unsubstituted alkoxide moieties, saturated cyclic alkoxide moieties, and alkoxide moieties which are otherwise substituted by one to three radicals which do not have an adverse effect on the charge priming agent may be the same or different.

28. A process according to claim 27, wherein said unsubstituted alkoxide moieties contain 1-12 carbon atoms.

29. A process according to claim 28, wherein said unsubstituted alkoxide moieties contain 1-6 carbon atoms.

30. A process according to claim 27, wherein said saturated cyclic alkoxide moieties are selected from cycloalkyloxy and cycloalkylalkoxy.

31. A process according to claim 27, wherein the substituents in said otherwise substituted alkoxy moieties are selected from halogen, alkoxy and aryl.

32. A process according to claim 25, wherein said step of treating includes surface reacting said particles with said at least one charge priming agent by adding the priming agent to the dispersed colorant particles and allowing the mixture to come to equilibrium with the carrier liquid and colorant particles before said at least one charge director is added.

33. Process according to claims 25 wherein said alkoxides comprise alkoxides of aluminum.

34. Process according to claim 33 wherein said alkoxide comprises aluminum tri(isopropoxide).

35. Process according to claims 33 wherein said alkoxide comprises aluminum tri(isobutoxide).

36. Process according to claim 33 wherein said alkoxide comprises aluminum tri(ethoxide).

* * * * *